US006247237B1

(12) United States Patent
Redburn et al.

(10) Patent No.: US 6,247,237 B1
(45) Date of Patent: Jun. 19, 2001

(54) ARCHERY SIGHT

(76) Inventors: Alan R. Redburn, 10579 S. Fenmore, Brandt, MI (US) 48614; Craig L. Redburn, 4130 Triwood La., Bridgeport, MI (US) 48722-9550

( * ) Notice: Subject to any disclaimer, the term of this patent is extended or adjusted under 35 U.S.C. 154(b) by 0 days.

(21) Appl. No.: 09/311,966

(22) Filed: May 14, 1999

Related U.S. Application Data

(60) Provisional application No. 60/085,555, filed on May 15, 1998.

(51) Int. Cl.[7] ..... F41G 1/467; F41G 1/32

(52) U.S. Cl. ..... 33/265; 33/241; 124/87

(58) Field of Search ..... 33/265, 234, 241; 24/87

(56) References Cited

U.S. PATENT DOCUMENTS

| | | | | |
|---|---|---|---|---|
| 1,256,987 | | 2/1918 | Dittemore | 33/241 |
| 1,307,912 | * | 6/1919 | Long | 33/246 |
| 2,654,152 | | 10/1953 | LaVire | 33/265 |
| 2,925,657 | | 2/1960 | Stenby | 33/241 |
| 2,969,594 | * | 1/1961 | Palmer | 33/241 |
| 3,820,248 | | 6/1974 | Hayward | 33/241 |
| 4,097,226 | | 6/1978 | Erikson et al. | 432/120 |
| 4,101,759 | | 7/1978 | Anthony et al. | 219/343 |
| 4,141,757 | | 2/1979 | Cline et al. | 148/1.5 |
| 4,157,564 | | 6/1979 | Anthony et al. | 357/60 |
| 4,159,215 | | 6/1979 | Chang et al. | 148/1.5 |
| 4,221,956 | | 9/1980 | Fielding et al. | 219/388 |
| 4,224,504 | | 9/1980 | Erikson et al. | 219/388 |
| 4,418,479 | | 12/1983 | Stachnik | 33/265 |
| 4,519,850 | | 5/1985 | Klug-Weiss | 148/1.5 |
| 4,620,372 | | 11/1986 | Goodrich | 33/265 |
| 4,928,394 | * | 5/1990 | Sherman | 33/265 |
| 5,201,122 | | 4/1993 | Annunziata | 33/265 |
| 5,339,227 | | 8/1994 | Jones | 33/265 |
| 5,341,791 | | 8/1994 | Shafer | 33/265 |
| 5,375,047 | | 12/1994 | Mueller | 33/265 |
| 5,383,278 | | 1/1995 | Kay | 33/265 |
| 5,394,615 | | 3/1995 | Hoppe et al. | 33/265 |
| 5,394,616 | | 3/1995 | Claxton | 33/DIG. 21 |
| 5,419,050 | | 5/1995 | Moore | 33/265 |
| 5,442,861 | | 8/1995 | Lorocco | 33/265 |
| 5,471,777 | | 12/1995 | McDonald | 33/241 |
| 5,493,450 | | 2/1996 | Ekstrand | 33/233 |
| 5,638,604 | | 6/1997 | Lorocco | 33/241 |
| 5,651,185 | | 7/1997 | Vanderheyden et al. | 33/265 |
| 5,970,214 | * | 10/1999 | Gat | 392/416 |
| 6,085,427 | * | 7/2000 | Persson | 33/241 |

FOREIGN PATENT DOCUMENTS

| | | |
|---|---|---|
| 0 101 762 | 3/1984 | (EP) . |
| WO83/03710 | 10/1983 | (WO) . |

* cited by examiner

*Primary Examiner*—Christopher W. Fulton
(74) *Attorney, Agent, or Firm*—Reising, Ethington, Barnes, Kisselle, Learman & McCulloch, P.C.

(57) ABSTRACT

The archery sight includes a mounting plate that is mounted on an archery bore. A sight support assembly is attached to the mounting plate by adjustment members. An elongated tubular sight tube is secured to the sight support assembly. A scintillating optical fiber rod is mounted in the forward end of the sight tube. A small diameter hole is bored in the center of the optical fiber rod. An opaque paint or a translucent material is placed in the hole. A tubular sleeve is mounted in the rear end of the sight tube. A light housing with a light and battery is secured to the mounting plate. A fiber optic cable carries light from the light housing to the forward end of the sight tube.

9 Claims, 9 Drawing Sheets

FIG-1
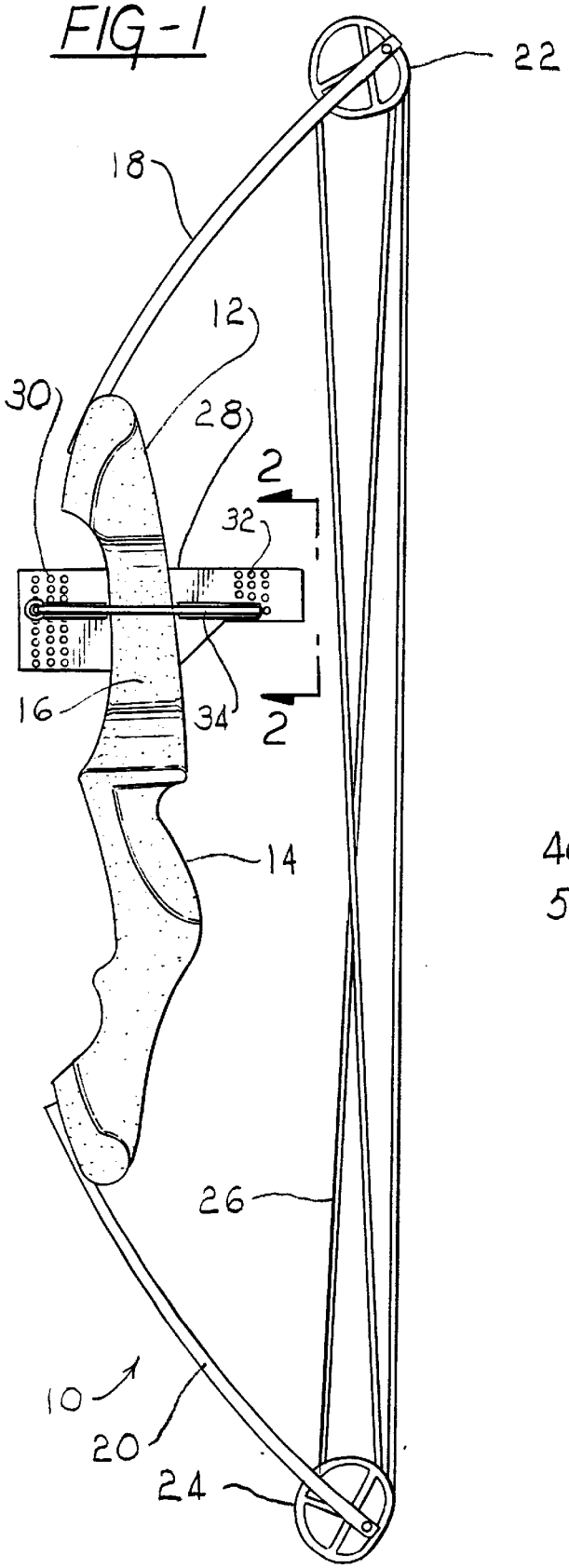
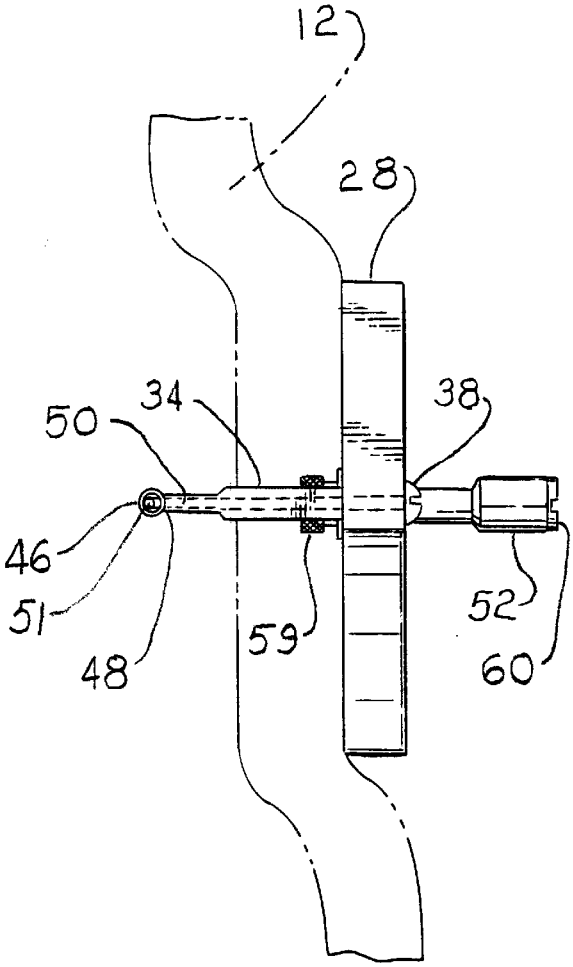
FIG-2

ARCHERY SIGHT

The disclosure incorporates the methods disclosed in provisional patent application Ser. No. 60/085,555, filed May 15, 1998, whose priority is claimed for this application.

BACKGROUND OF THE INVENTION

1. Technical Field

This invention relates to archery sights, and more particularly to an illuminated collimator sight that simultaneously aligns the archery bow with the archer and aligns the bow with a target.

2. Description of the Prior Art

A variety of different sights have been tried by archers. Some of these sights have illumination, for use during periods of reduced lighting, and others do not. Most of the sights employed in the past have been difficult to use.

A bow needs to be properly positioned relative to the horizon and to a target to consistently hit the target. To properly position the bow, the archer's eyes need to be positioned in the same place relative to the bow each time an arrow is launched toward a target. These requirements have been difficult to meet in practice. A simple sight includes a piece with a small aperture or pinhole peep mounted on a bowstring and a small sphere or cross-hairs fixed relative to the center portion of the bow. The archer looks through the small aperture, centers the sphere relative to the aperture and positions the sphere relative to the target. With this type of sight the archer's eye must simultaneously align three separate members and locate the distant target looking through a pinhole peep. The eye can focus on one object at a time and can simultaneously see two spaced apart objects fairly well. The third object, normally the pinhole peep, is unclear or fuzzy. Alignment of the eye relative to the pinhole peep can be difficult to maintain under the best of conditions.

Archery bows have also been provided with an alignment device for aligning the bow relative to the archer's eye and a separate sighting device for aiming at the target. Alignment of the bow with the archer's eye is obtained first and then the eye is shifted to the sighting device and the bow is aligned with a target. Maintaining two separate alignments requires frequent shifting of the eye between the target and the alignment device. Because the sighting device and the alignment device are on different axes, the bow is adjusted for one individual only and generally requires readjustment for use by another individual.

SUMMARY OF THE INVENTION

An object of the invention is to provide a sight on an archery bow that automatically aligns the archer relative to the bow when the sight is aligned with the target. Another object of the invention is to provide an archery sight that is illuminated for use during periods of reduced light. A further object of the invention is to provide an archery sight that aligns the bow with the target when the archer aligns the sight with the target. A still further object of the invention is to provide an archery sight that does not require readjustment for each individual archer that uses the bow. A yet further object of the invention is to provide an archery sight that has minimal interference with an archer's view of the target.

The sight has an elongated small diameter tube adjustably connected to a bow. A light is provided in the end of the tube that is facing away from an archer. The light can be seen only when the eye of an archer is in substantial alignment with the axis of the tube. The axis of the elongated tube is in alignment with a target when the archer places the small illuminated dot in the tube on the target. The archer's view of the target is obstructed only by the end of the tube and the edge of a thin tube support. An archer's eye is able to focus on the target around the outside of the tube except for a small portion of the target that is obscured by the tube's support. The target is not viewed through the tube.

THE DRAWINGS

The presently preferred embodiment of the invention is disclosed in the following description and in the accompanying drawings, wherein:

FIG. 1 is a side elevational view of an archery bow with an archery sight attached;

FIG. 2 is an enlarged sectional view taken along line 2—2 and FIG. 1;

DESCRIPTION OF THE PREFERRED EMBODIMENTS

Figure 3:
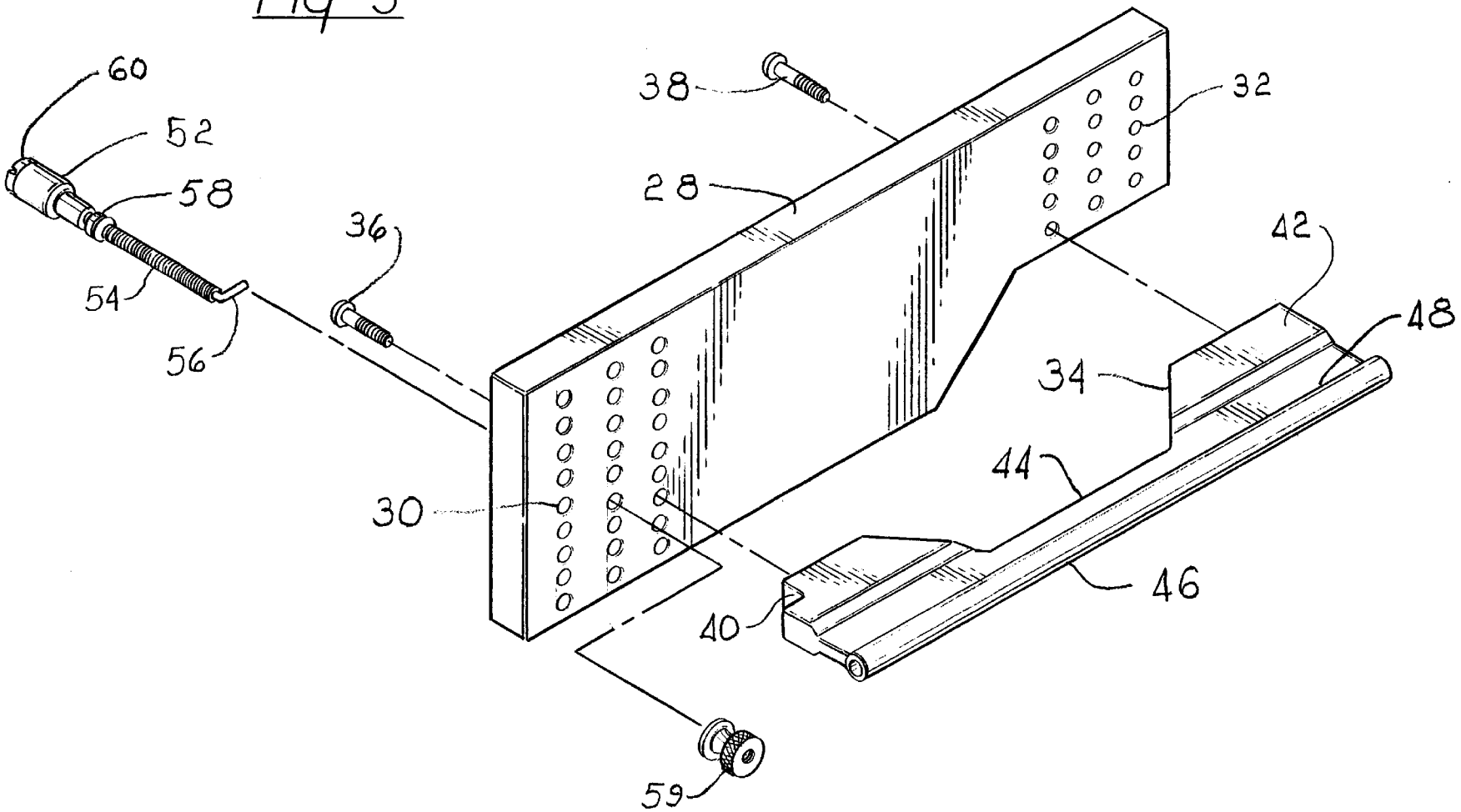
FIG. 3 is an enlarged expanded perspective view of the archery sight mounting plate, the bow sight support assembly, the elongated sight tube, and a light source.

The archery bow generally designated by the reference number 10 includes a rigid upright 12 with a handgrip section 14 and a plate portion 16. A flat upper leaf spring 18 and a lower leaf spring 20 are connected to the upright 12. An upper pulley 22 is journaled on the free end of the upper leaf spring 18. A lower pulley 24 is journaled on the lower leaf spring 20. A bow string 26 is trained around the upper pulley 22 and the lower pulley 24.

A mounting plate 28 is rigidly secured to the plate portion 16 of the upright 12 by mechanical fasteners. A plurality of front adjustment apertures 30 and rear adjustment apertures 32 are provided in the mounting plate 28.

A bow sight support assembly 34 is secured to the mounting plate 28 by a front screw 36 and a rear screw 38. The front screw 36 passes through a selected one of the front adjustment apertures 30 and screws into a threaded bore in the front portion 40 of the sight support assembly 34. The rear screw 38 passes through a selected one of the rear adjustment apertures 32 and screws into a threaded bore in the rear portion 42 of the sight support assembly 34. The sight support assembly 34 has a cutout at 44 that allows the support assembly to bridge across the plate portion 16 of the upright 12. An elongated sight tube 46 is secured to the outboard edge 48 of the support assembly 34 by braising or other attaching procedures. The outboard edge 48 of the support assembly 34 has a reduced thickness that reduces the size of the end surface 50 that an archer sees when aiming at a target. The elongated sight tube 46 may have an outside diameter of 3/16 inch and an inside diameter of 1/8 inch and a length of 6 inches. These dimension can be varied somewhat without significantly changing the accuracy of the sight. The outside diameter of the sight tube 46 must be small enough for an archer's eye to focus on a target substantially all around the circumference of the sight tube. The inside diameter of the sight tube 46 must be sufficiently large to allow an archer to see an illuminated spot inside the far end of the tube without too much difficulty. If the inside diameter of the sight tube 46 is too small it will take the archer too long to align the sight tube and see the illuminated spot. The length of the sight tube 46 must be sufficiently long to ensure that an archer's eye is in alignment with the axis of the tube when he looks through the tube to its far end.

A fiber optic light source 52 has a threaded stem 54 that is inserted into one of the front adjustment apertures 30 in the mounting plate 28. The bent end 56 of the light source 52 is inserted into the forward end of the sight tube 46 and nuts 58 and 59 are adjusted to hold the bent end 56 centered in the sight tube. The cap 60 of the light source 52 is rotated in one direction to advance two small batteries into contact with an electrode and energize a light source. A fiber optic cable 51 carries the light through the threaded stem 54 into the free end of the bent end 56. The cap 60 is rotated in an opposite direction to turn the light source 52 off. A red light has been found to work well, however a different color can be used if desired.

The mounting plate 28 with front adjustment apertures 30 and rear adjustment apertures 32 provides a finite number of elevation adjustments. Mounting plate 62 shown in FIG. 4 has a front elevational slot 64 and a rear elevational slot 66. Both slots 64 and 66 are arcuate. Threaded members 68 and 70 that extend to the side of the bow sight support assembly 72, are received in the elevation slots 64 and 66. Nuts 74 on the threaded member 68 and 70 can be tightened to secure the sight support assembly 72 relative to the mounting plate 62. The fiber optic light source 52 is secured to a light source slot 76 in the mounting plate 62. An elongated sight tube 46 is secured to or integral with the sight support assembly 72.

Elevation adjustments are made, when using the mounting plate 28, shown in FIGS. 1, 2 and 3 by removing one or both of the screws 36 and 38, switching them to different apertures 30 and 32 and then screwing them into the bow sight support assembly 34. Lateral or windage adjustments are made by inserting or removing shims from between the mounting plate 28 and the sight support assembly 34 and then securing the shims by tightening the front and rear screws 36 and 38.

Figure 4:
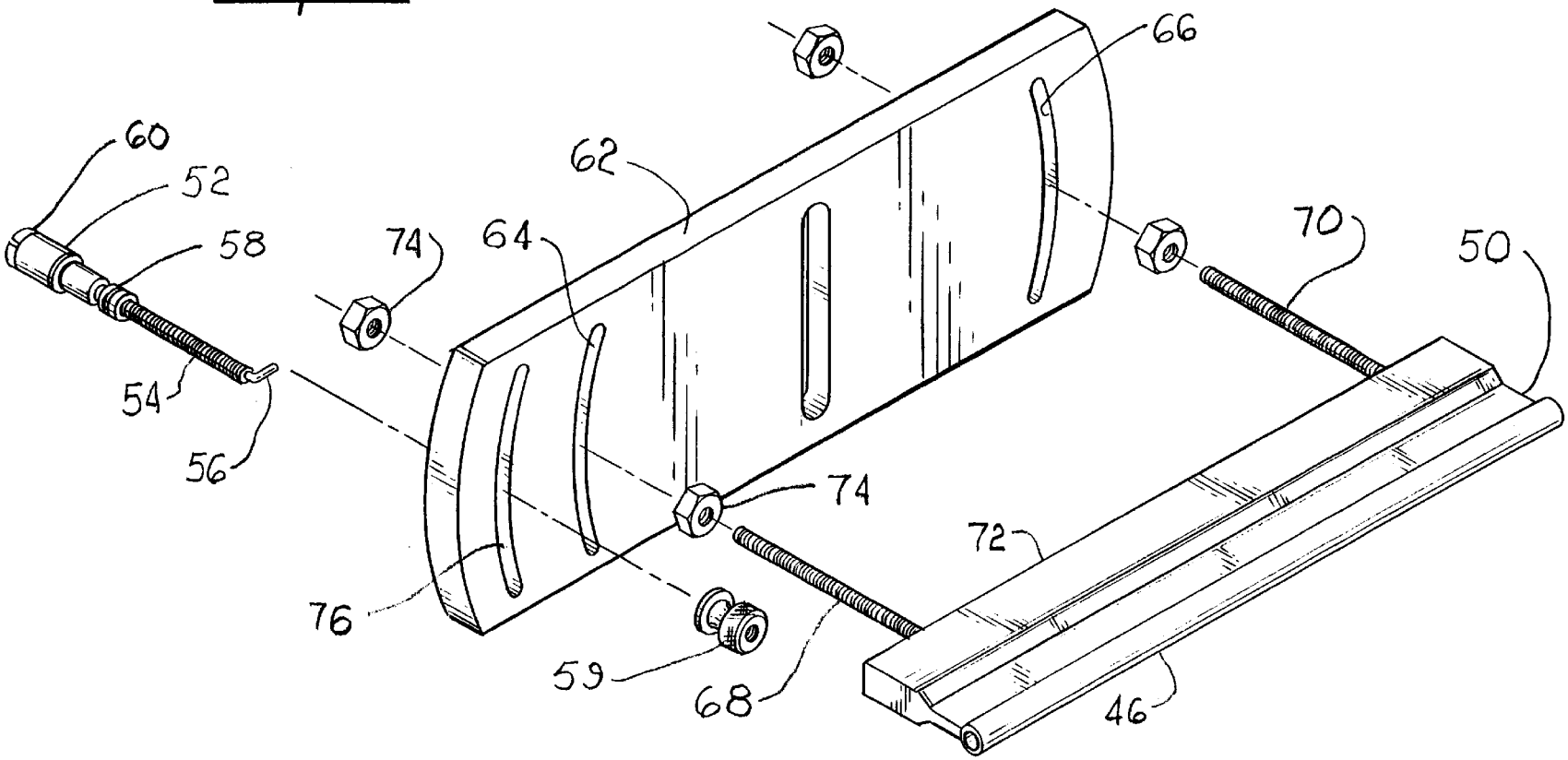
FIG. 4 is an enlarged expanded perspective view similar to FIG. 3 with an alternate sight mounting plate and sight support assembly.

Elevation adjustments are made when employing the mounting plate 62, shown in FIG. 4, by loosening one or more of the nuts 74 on the threaded members 68 and 70 and then sliding the threaded members to new locations within the front and rear elevation slots 64 and 66. When the sight support assembly 72 is in the desired position, the nuts 74 are retightened. Markings can be placed on the mounting plates 28 and 62 to indicate range if desired. Windage adjustments are made when employing the mounting plate 62 by loosening a nut 74 on one side of the mounting plate and tightening a nut 74 on the opposite side of the mounting plate. If a large windage adjustment is required all four nuts can be changed. The fiber optic light source 52 is loosened anytime the elongated sight tube 46 is repositioned relative to a mounting plate 28 or 62 to prevent damage to the light. After the sight tube 46 is repositioned, the light 52 is repositioned and the nuts 58 and 59 are tightened to hold the bent end 56 in the center of the forward end of the sight tube 46.

When preparing to launch an arrow toward a target, an archer holds the bow 10 and an arrow in the normal prescribed manner with the light source 52 on. The archer then positions the bow 10 in a position in which he can see a spot of light in the elongated sight tube 46. The archer then moves his body and the bow 10 together until the round illuminated dot inside the sight tube 46 appears to be positioned in the center on the target. When the illuminated dot is centered on the target, the bow 10 is in alignment with the target and the archer is in alignment with the bow. The arrow can then be released to strike the target.

Figure 5:
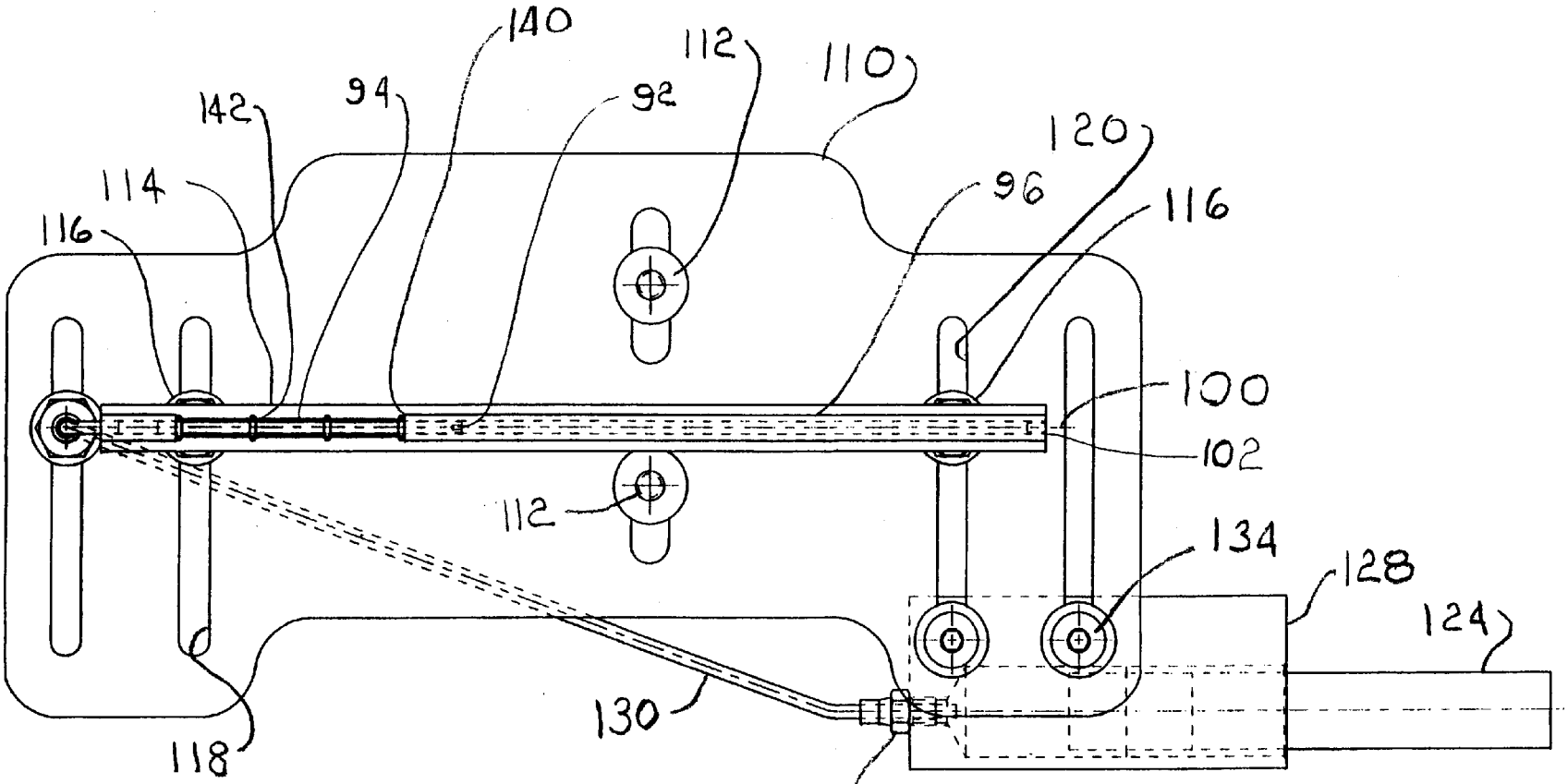
FIG. 5 is a side elevational view of an alternate version of the sight with improved accuracy.
Figure 6:
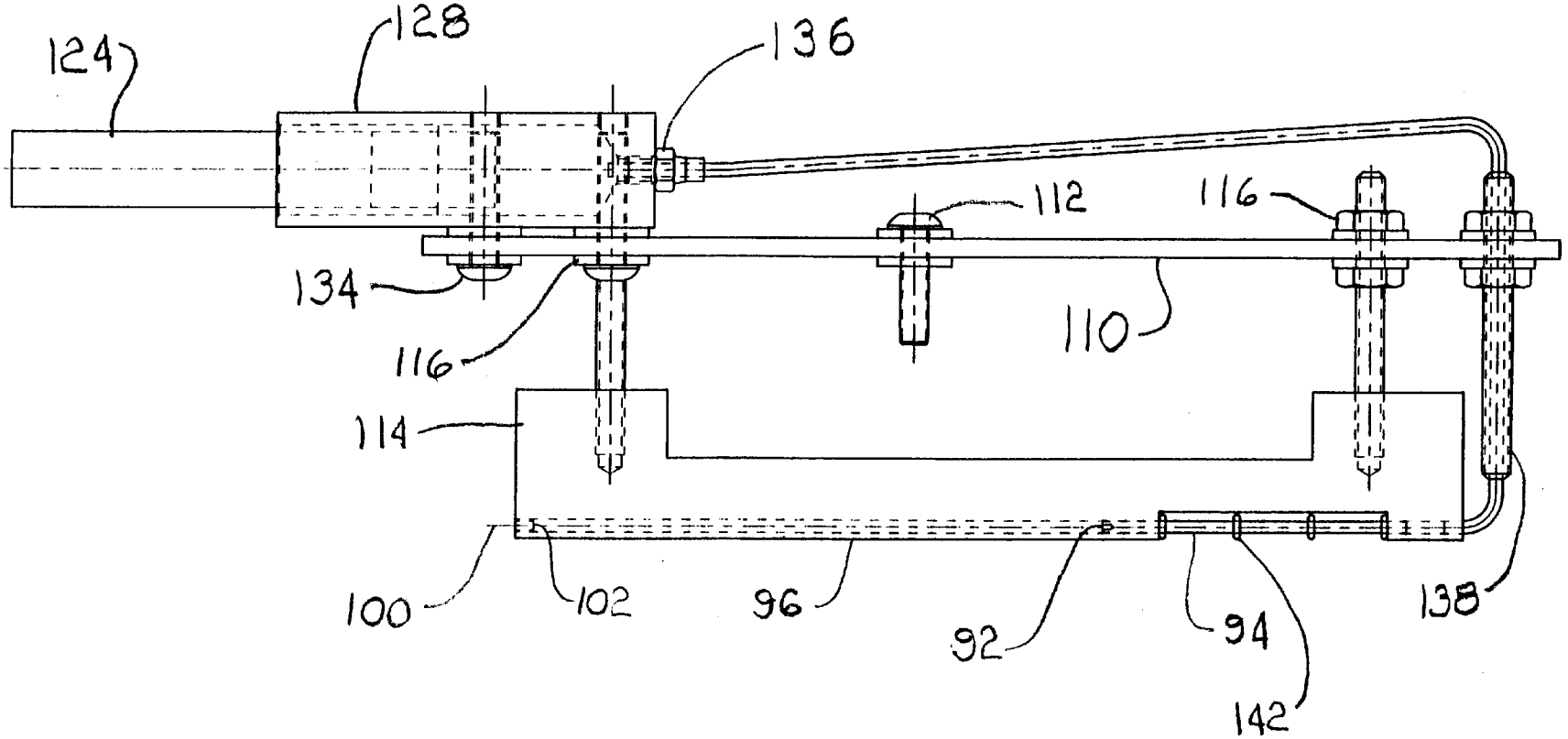
FIG. 6 is a plan view of the sight shown in FIG. 5.
Figure 7:
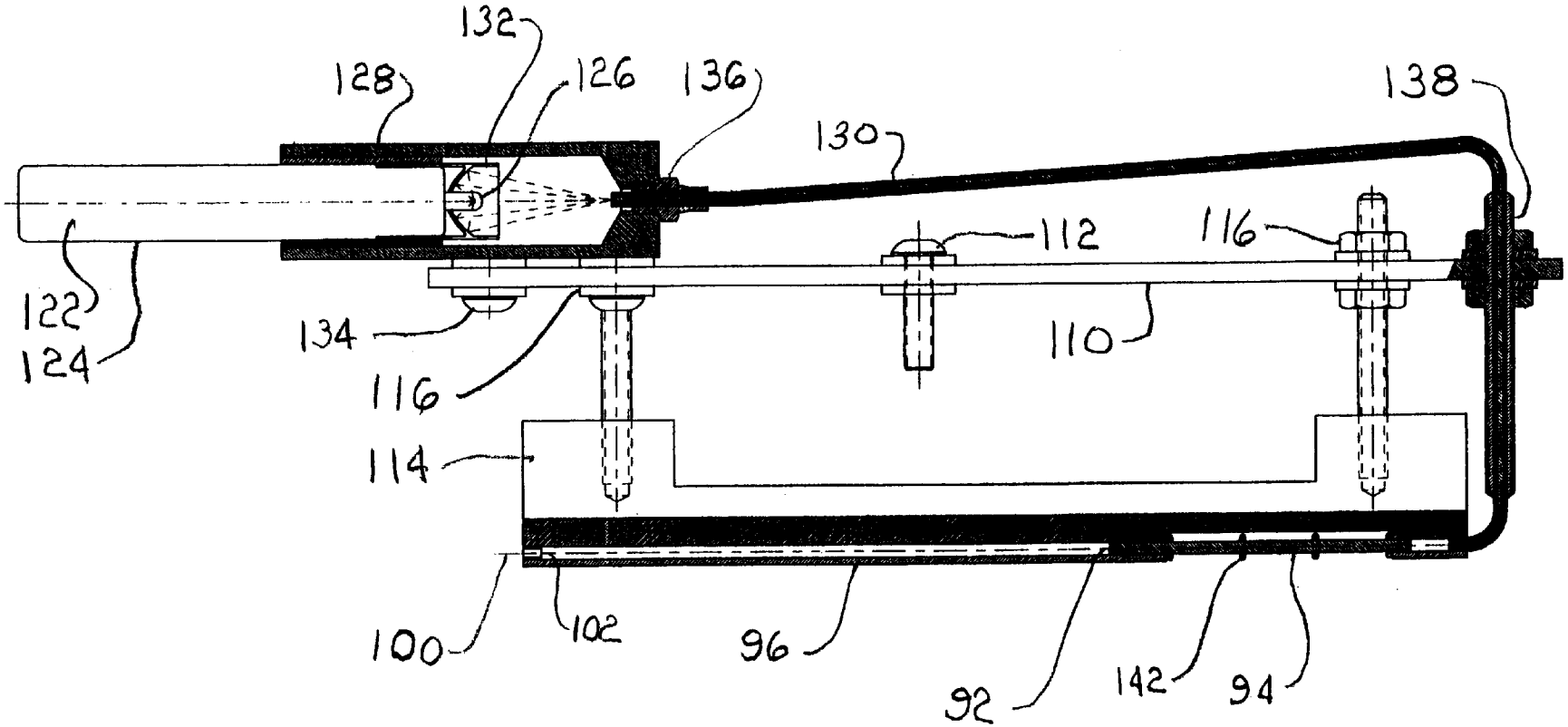
FIG. 7 is a view similar to FIG. 6 with some parts in section.
Figure 8:
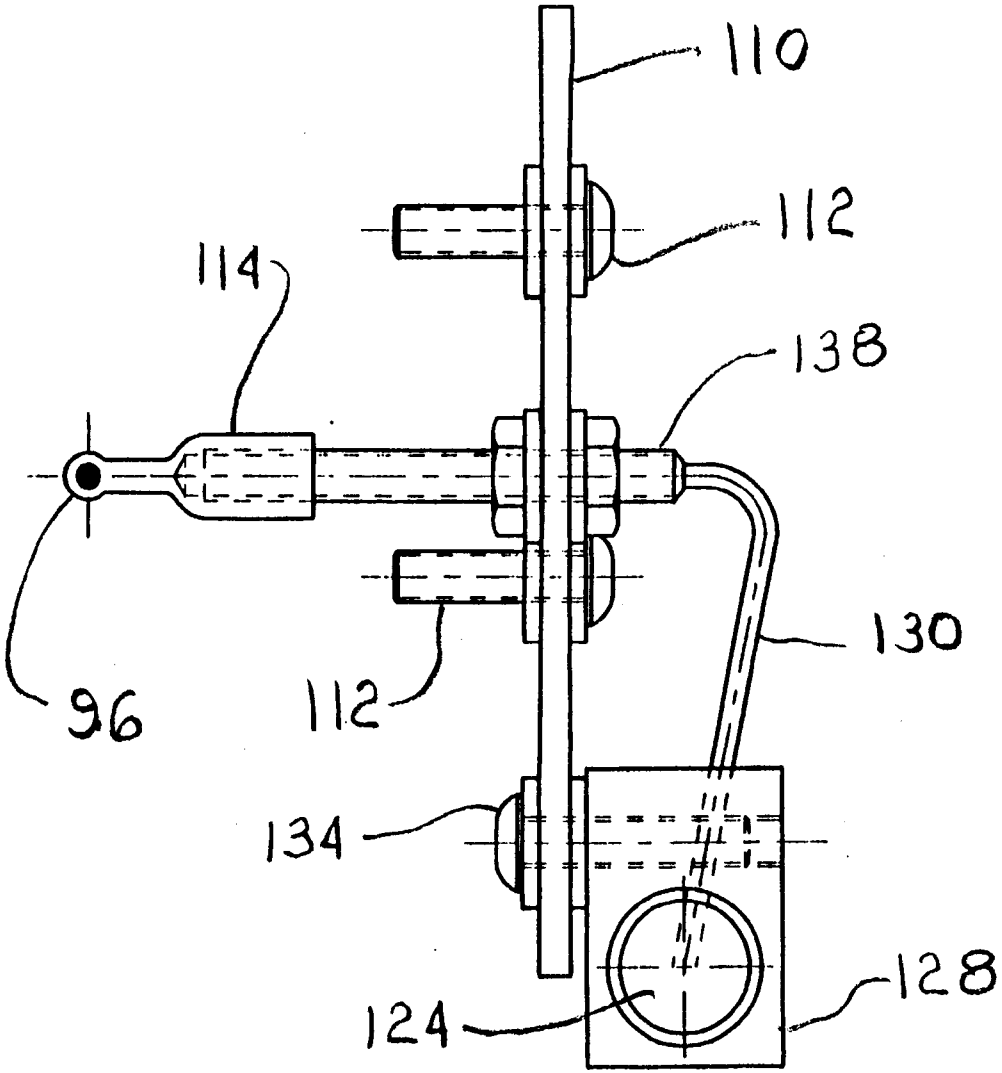
FIG. 8 is a right end elevational view of the sight as shown in FIG. 5.
Figure 9:
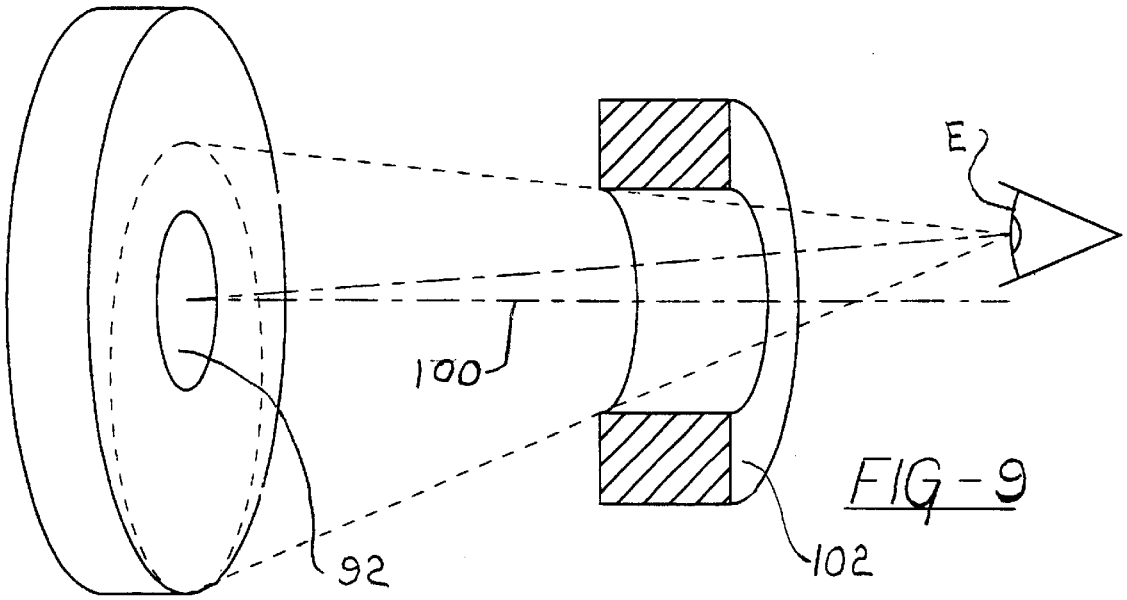
FIG. 9 is a schematic showing an archer's eye out of alignment with the sight.
Figure 10:
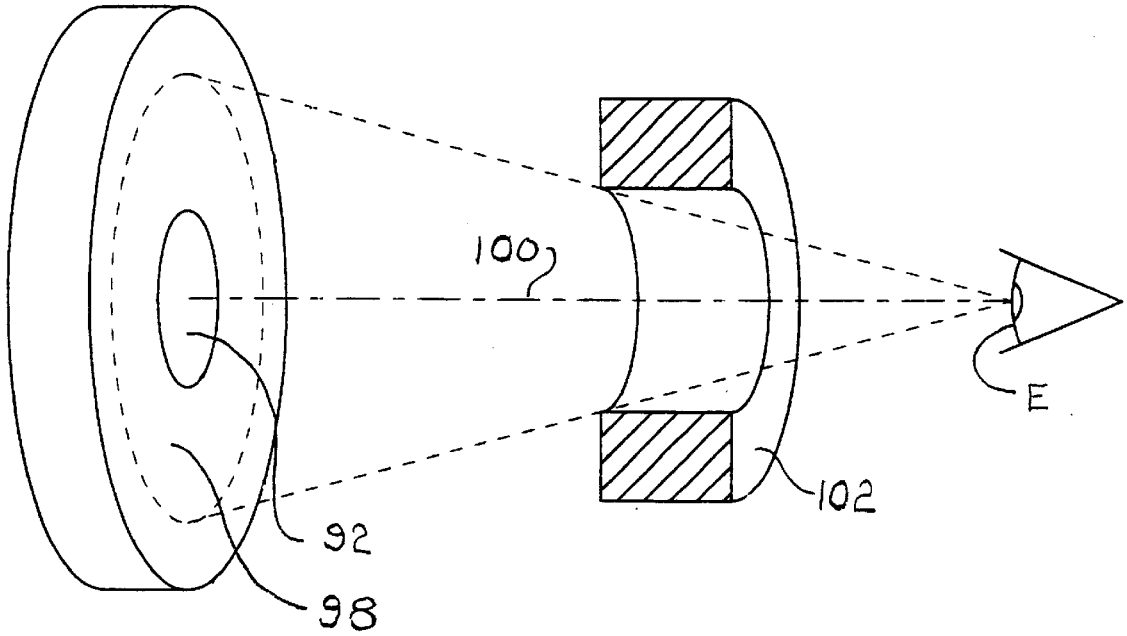
FIG. 10 is a schematic similar to FIG. 9 with the archer'eye in alignment with the sight.

The accuracy of the sight described above can be improved by providing a black dot 92 in the center of the end of the scintillating optical fiber light source 94 in the sight tube 96 as shown in drawing FIGS. 5, 6 and 7. The black dot 92 provides an illuminated donut 98. It is relatively easy to align a person's eye on the center line 100 of the sight tube 96 where the width of the illuminated donut-shaped area 98 is the same on the right and left sides as well as on the top and bottom, as shown in FIG. 10. Without the center black dot 92, a person using the sight will see an ellipse if his eye is a little off the center line 100 of the sight tube 96. It can be difficult to distinguish between a circular disk and a slightly elliptical disk that is seen without the center black dot 52 when the eye E is off the center line 100.

The employment of a sleeve 102 in the end of the sight tube 96 nearest a person's eye E essentially makes the inside diameter of most of the sight tube 96 larger than the inside diameter of the sleeve. This provides a larger field of view than the inside diameter of the sleeve 102. The result is a sight tube 96 which is easier to align with a person's eye E without a decrease in accuracy.

The center dot 92 shown in FIGS. 5, 6 and 7 can be a shape other than circular if desired. The center dot 92 can also be illuminated in a contrasting color that enhances the donut-shaped area 98.

Figure 11:
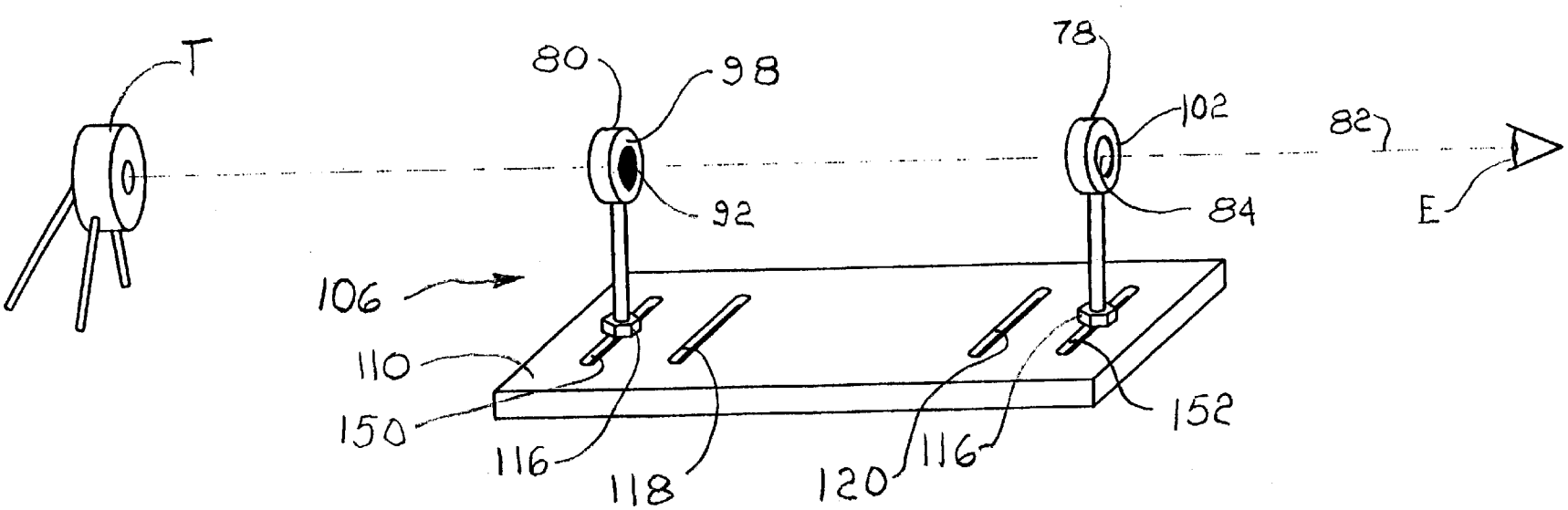
FIG. 11 is a schematic of a sight without illumination.

The two-post sight 106, which may be used for initial adjustment of the sight tube 96, has a black rear peep sight 78, that corresponds to the sleeve 102, and a forward sight member 80 with a white donut-shaped surface 98 with a black center 92. This sight is essentially the same as the sight tube sight 96 without illumination. When the two posts are in alignment with a person's line of sight 82, the person will see a white donut-shaped area 98 with a center black dot 92 only through the rear peep sight 78 as shown in FIG. 11. The target T cannot be seen through the aperture 84 through the rear peep sight 78. The target T is observed around the outer edges of the sight members 78 and 80. The outer diameter of the sight members 78 and 80 is therefore as small as practical.

The sight tube 96 and the front and rear side members 78 and 80 are mounted on a mounting plate 110. The mounting plate 110 is attached to the plate portion 16 of an archery bow 10 by screws 112. The sight tube 96 is adjustably attached to the mounting plate 110 by a sight support assembly 114 and nuts 116. Straight slots 118 and 120 are used to facilitate vertical adjustment.

A small light assembly 122 with a battery case 124, a light 126, and a reflector 132 are mounted in an illumination housing 128. The light 122 is adjustable relative to the reflector 132. Adjusting the light 122 changes the focus of light on a fiber optic cable 130. The illumination housing 128 is secured to the mounting plate 110 by screws 134.

One end of the fiber optic cable 130 is secured to the illumination housing 128 by a collate 136. The cable 130 passes through a conduit 138 and into a forward end of the sight tube 96. Light from the fiber optic cable 130 is transmitted to a scintillating optical fiber light source 94. The dot 92 in the center of the donut-shaped surface 98 is formed by drilling a small hole in the end face of the light source 94 and filling the hole with paint. The paint, which is opaque, creates a black dot 92 regardless of the paint color. The paint could be replaced by a translucent material which changes the black dot 92 to an illuminated dot. If the color of the dot 92 is different from the color of the donut-shaped area 98, it may function as well or better than the black dot 92.

A slot 140 is provided on the sight tube 96 to permit the optical fiber light source 94 to receive ambient light. With ambient light, it is not necessary to use the light 122 during periods of adequate natural illumination. A plurality of small O-rings 142 are placed on the optical fiber member 94 to block the view of a bow hunter from light emitted by the fiber optic member 94 when using the sight. The large slot 140 can be replaced by a plurality of small slits in the sight tube 96 with a passage of ambient light and the O-rings 142 can be eliminated.

The fiber optic cable 130 can furnish light directly to the sight tube 96 and the illuminated donut-shaped surface 98 and the black dot 92 can be directly on the fiber optic cable. With this arrangement, the light on 22 would be required any time the sight is used. The sight shown in FIGS. 1–4 can also be provided with a centered black dot to improve accuracy.

The sight tubes 46 and 96 must have a small diameter for a hunter to see the target while his eye E is on the sight tube center line 100. Unlike a peep sight, a hunter cannot see a target through the sight tubes 46 or 96. The small diameter of the sight tube 46 or 96 makes it difficult for some individuals to align an eye E with the sight tube and see the light in the tube. For such individuals, a sight tube 46 or 96 with a somewhat larger internal diameter can be used. The larger diameter sight tube will not have a significant effect on accuracy. However, the large diameter sight tube 46 or 96 will increase the diameter of the illuminated area that is centered on a target. If the target is small or far away, the illuminated donut-shaped area 98 may appear to be larger than the target, thereby preventing an archer from seeing the target.

The rear peep sight 78 and the forward sight member 80, shown in FIG. 11, can be employed for initial alignment of the sight tube 46 or 96 if desired. The peep sight 78 and the sight member 80 provide the sight picture as the sight tube 96. Both the peep sight 78 and the sight member 80 are secured in the outer slots 150 and 152. Adjustments are made as required. The sight tube 46 or 96 is mounted between and in alignment with the peep sight 78 and the sight member 80 in the inner slots 118 and 120. The peep sight 78 and the sight member 80 have outer diameters that are substantially the same as the outer diameter of the sight tube 46 or 96 to facilitate alignment of the sight tube. The peep sight 78 and the sight member 80 are then removed. During periods with adequate natural light, the peep sight 78 and the sight member 80 can be used as a sight without the sight tube 46 or 96.

The donut-shaped surface 98 is preferably one color such as red and the center dot 92 is a contrasting color. The colors can be obtained by using a colored light 126, a colored optical fiber 94 or a colored filter. If the dot 92 is translucent, it would also require coloring or a filter.

The disclosed embodiments are representative of presently preferred forms of the invention, but are intended to be illustrative rather than definitive thereof. The invention is defined in the claims.

We claim:

1. An archery sight comprising a mounting plate adapted to be mounted on an archery bow, a sight support assembly secured to the mounting plate for range adjustment and for windage adjustment;

an elongated sight tube supported by the sight support assembly and having an axis that intersects the expected path of an arrow propelled by the archery bow and an outside tube diameter that permits a human eye to see a target when on a center axis of the tube;

a fiber optic member having an end mounted in a forward end of said elongated sight tube with an end face facing toward and spaced from a rear end of said elongated sight tube; and an opaque dot mounted on the center portion of the end face of the fiber optic member.

2. An archery sight as set forth in claim 1 wherein the opaque dot is mounted in a bore in the center portion of the end face of the fiber optic member.

3. An archery sight as set forth in claim 1 wherein the rear end of said elongated sight tube has an internal diameter that is smaller than the internal diameter of a center portion of the elongated sight tube.

4. An archery sight as set forth in claim 1 including a tubular member mounted in an internal bore through the elongated sight tube adjacent to the rear end of said elongated sight tube.

5. An archery sight comprising a mounting plate adapted to be mounted on an archery bow;

a sight support assembly adjustably secured to the mounting plate;

an elongated sight tube supported by the sight support assembly and having a sight tube axis, a rear end, and a forward end;

a fiber optic member having a fiber optic end mounted in the forward end of the elongated sight tube with a fiber optic end face facing toward and spaced from the rear end of said elongated sight tube; and a translucent dot on the fiber optic end that is concentric with the sight tube axis.

6. An archery sight as set forth in claim 5 wherein the translucent dot is mounted in a bore in the fiber optic end face of the fiber optic member.

7. An archery sight as set forth in claim 5 wherein the rear end of said elongated sight tube has an internal diameter that is smaller than the internal diameter of a center portion of the elongated sight tube.

8. An archery sight as set forth in claim 5 including a tubular sleeve mounted in an internal bore through the elongated sight tube adjacent to the rear end of the elongated sight tube.

9. An archery sight as set forth in claim 5 wherein light passing through the fiber optic end face has a different color than light passing through the translucent dot.

* * * * *

UNITED STATES PATENT AND TRADEMARK OFFICE

CERTIFICATE OF CORRECTION

PATENT NO. : 6,247,237 B1
DATED : June 19, 2001
INVENTOR(S) : Alan R. Redburn et al.

It is certified that error appears in the above-identified patent and that said Letters Patent is hereby corrected as shown below:

Title page,
Item [56] References Cited, column 1, cancel the following listed references in their entirety "4,097,226; 4,101,759; 4,141,757; 4,157,564; 4,159,215; 4,221,956; 4,224,504; 4,519,850"; and in column 2, cancel the following listed reference in its entirety "5,970,214".
FOREIGN PATENT DOCUMENTS, cancel the following listed references in their entirety "EP 0 101 762; WO83/03710"

Column 2,
Line 36, change "archer' eye" to -- archer's eye --.

Column 4,
Line 25, "52" to -- 92 --.

Signed and Sealed this

Nineteenth Day of February, 2002

*Attest:*

*Attesting Officer*

JAMES E. ROGAN
*Director of the United States Patent and Trademark Office*